US010046348B2

(12) United States Patent
Brugger

(10) Patent No.: US 10,046,348 B2
(45) Date of Patent: Aug. 14, 2018

(54) METERING DISPENSER FOR DISCHARGING AN IN PARTICULAR PASTY OR VISCOUS MATERIAL, SUCH AS COSMETIC CREAMS, ADHESIVES AND THE LIKE

(71) Applicant: Gerhard Brugger, Pflach (AT)

(72) Inventor: Gerhard Brugger, Pflach (AT)

( * ) Notice: Subject to any disclaimer, the term of this patent is extended or adjusted under 35 U.S.C. 154(b) by 0 days.

(21) Appl. No.: 15/034,790

(22) PCT Filed: Jun. 16, 2014

(86) PCT No.: PCT/EP2014/001632
§ 371 (c)(1),
(2) Date: May 5, 2016

(87) PCT Pub. No.: WO2015/070935
PCT Pub. Date: May 21, 2015

(65) Prior Publication Data

US 2016/0279653 A1 Sep. 29, 2016

(30) Foreign Application Priority Data

Nov. 12, 2013 (DE) ..... 10 2013 018 937

(51) Int. Cl.
*B05B 11/00* (2006.01)
*A45D 34/04* (2006.01)
*A46B 11/00* (2006.01)

(52) U.S. Cl.
CPC ..... *B05B 11/0054* (2013.01); *A45D 34/04* (2013.01); *B05B 11/0032* (2013.01);
(Continued)

(58) Field of Classification Search
CPC ..... A45D 34/04; A45D 2200/056; A46B 11/0058; B05B 11/0054; B05B 11/0032;
(Continued)

(56) References Cited

U.S. PATENT DOCUMENTS 5,251,992 A * 10/1993 Iizuka ..... A45D 34/042 15/168
7,314,329 B1 1/2008 Byun
(Continued)

FOREIGN PATENT DOCUMENTS

| | | |
|---|---|---|
| DE | 68922886 | 10/1995 |
| EP | 0357456 | 9/1989 |
| EP | 0357456 | 3/1990 |
| EP | 1547694 | 6/2005 |
| FR | 2922534 | 4/2009 |
| FR | 2975978 | 6/2011 |

(Continued)

OTHER PUBLICATIONS

European Patent Office, International Search Report, dated Aug. 6, 2014.

*Primary Examiner* — Nicholas J Weiss
(74) *Attorney, Agent, or Firm* — Price Heneveld LLP

(57) ABSTRACT

The invention relates to a metering dispenser for putting out pasty or viscous material, comprising a dispenser housing, a cartridge arranged therein, an applicator and a pump unit. The metering dispenser according to the invention is provided with an actuating device which is formed by a push button, wherein the pump unit is activated by pushing the push button into the housing in order to put out the material.

12 Claims, 16 Drawing Sheets

(52) U.S. Cl.
CPC ..... *B05B 11/0035* (2013.01); *B05B 11/0064* (2013.01); *B05B 11/3004* (2013.01); *B05B 11/3015* (2013.01); *B05B 11/3047* (2013.01); *B05B 11/3074* (2013.01); *A45D 2200/056* (2013.01); *A46B 11/0058* (2013.01); *A46B 2200/1046* (2013.01); *B05B 11/0037* (2013.01); *B05B 11/0048* (2013.01); *B05B 11/3052* (2013.01)

(58) Field of Classification Search
CPC ..... B05B 11/0035; B05B 11/0064; B05B 11/3004; B05B 11/3015; B05B 11/3047; B05B 11/3074; B05B 11/0048; B05B 11/3052
See application file for complete search history.

(56) References Cited

U.S. PATENT DOCUMENTS

| | | | | |
|---|---|---|---|---|
| 9,370,233 | B2 * | 6/2016 | Jung | A45D 34/041 |
| 2011/0170934 | A1 * | 7/2011 | Ki | A45D 34/04 401/118 |
| 2016/0144395 | A1 * | 5/2016 | Brugger | A45D 40/262 401/150 |

FOREIGN PATENT DOCUMENTS

| | | |
|---|---|---|
| JP | H03289480 | 12/1991 |
| KR | 101252115 | 4/2013 |
| WO | 2008072823 | 6/2008 |

* cited by examiner

METERING DISPENSER FOR DISCHARGING AN IN PARTICULAR PASTY OR VISCOUS MATERIAL, SUCH AS COSMETIC CREAMS, ADHESIVES AND THE LIKE

BACKGROUND OF THE INVENTION

The invention relates to a metering dispenser. The invention relates in particular to a one component metering dispenser which facilitates putting out a material or a component in particular by an applicator arranged at the metering dispenser.

Metering dispensers of this type have been commercially available in various embodiments for years and are mostly used for cosmetics in order to perform a metered dispensing of creams, gels and similar. These metering dispensers are used more and more also for other applications, in particular in the technical field, like e.g. for glues and similar. This is a typical mass product where a simple configuration and ease of manufacture are important and otherwise at the same time a pleasing design has to be achieved, in particular for the main application in the cosmetic field. It is evident from a review of the prior art that it is difficult to satisfy all these requirements at the same time.

Known metering dispensers typically have a metering dispenser housing with a cartridge firmly arranged therein for receiving the material or the component to be put out and a pump unit or an applicator arranged at the end. The output is typically provided by an actuation member thus a laterally arranged push button or an adjustment button arranged at the bottom which rotates a push drive arranged in the dispenser housing, in particular a threaded rod which continuously advances a piston arranged at a bottom end of the cartridge due to the translatoric movement, so that the material can be put out from the cartridge. It is evident that this causes significant mechanical complexity which is a disadvantage for a mass product. It is a particular disadvantage of these metering dispensers that handling is not optimized because the push button or adjustment button is typically manually actuated for metering but the metering dispenser is then repositioned in a hand in order to apply the dispensed material volume to the surface to be treated. Also this is complicated and disadvantageous.

Eventually metering dispensers are known (DE 20 2010 009 751 U1 and DE 20 2010 011 248 U1) which are characterized by a compact configuration and which have proven successful in practical applications. These metering dispensers are typically used for 2 component metering dispensers in which two respective cartridges are respectively inserted in a dispenser housing and in which a metered dispensing of materials received in the cartridge can be provided through an adjustment device arranged at a base below the cartridge in predetermined or adjusted mixing ratios. These known cartridges are characterized by an advantageously configured pump unit with a pump cylinder and a pump piston cooperating therewith wherein a compression spring is arranged between the pump cylinder and the pump piston. Actuation or putting out the components is performed by actuating the piston of the pump unit that is arranged in front of the cartridge.

Last not least a metering dispenser is known (DE 689 22 886 T2) in which a pin shaped housing which receives all elements of the metering dispenser is formed by plural individual components that are joined an connected with each other, namely a lower housing element, a sleeve that is arranged thereon and firmly connected with the housing body in an axial direction wherein the sleeve is rotate ably supported relative to the housing body, a pump housing attached in the sleeve through a snap connection and an additional housing body arranged thereon and connected with the pump housing through an interlocking and/or snap locking connection for receiving an applicator so that the housing is made from a plurality of different components which causes a complex configuration that is difficult to produce and difficult to assemble.

Within the pump housing, the sleeve and the housing element the pump elements are received, wherein the actuation of the pump is performed by an axial push button which axially adjusts a cartridge for receiving the cosmetic material within the housing element together with pump element so that an output of cosmetic material in upward direction towards the applicator is facilitated.

The metering dispenser is made from a plurality of individual components, wherein in particular the housing is provided as a plurality of individual components. This yields overall a complex assembly and production due to the plurality of components required which additionally have to be matched. A disadvantage which is significant in particular for mass production is furthermore that the functionality of the metering dispenser can only be tested after all components have been assembled. If the metering dispenser does not work the entire assembled component is scrap.

As stated supra there are many configurations of metering dispensers which however do not fulfill long felt need for various reasons. This is based on the fact that metering dispensers are rather slender and elongated because several components have to be housed therein, namely typically a pump unit including a pump cylinder, piston and valve, applicator a cartridge for the material to be put out, an actuation button, a cap and a dispenser housing. It is important to put these components together in the most space saving manner possible connected by several interfaces in a simple manner and thus to configure the components in a simpler manner so that they can be produced in a cost effective manner through plastic injection molding. This is very important for acceptance of the metering dispensers in the market place because the products cannot be successively sold in the market place in case the metering dispensers do not satisfy these criteria. Additionally simple and reliable operation of the metering dispenser has to be provided. Furthermore care has to be taken, that material is material is not put out by accident through careless storing or handling of the metering dispenser. Additionally putting out the material has to be performed with an exact quantity and evenly and in particular a material trail wake shall be excluded. Furthermore also a rather firm connection between the components is required for providing a stable metering dispenser so that handling the metering dispenser can be provided in a reliable manner. Simultaneously handling the metering dispenser also has to be simple with respect to handling and actuation properties. By nature it is difficult to satisfy all these criteria which is the object of the instant invention.

SUMMARY OF THE INVENTION

According to the invention a metering dispenser for putting out materials, in particular cream consistency cosmetic material includes an elongated advantageously pin shaped dispenser housing in which a cartridge is received that is moveable along the axis of the dispenser housing as well as a pump unit, an applicator for putting gout the material and an actuation device for actuating the pump unit which is formed according to the invention by a push button. The push button is received at one housing end and thus axially moveable in a direction of a longitudinal axis of the housing so that axial pressing of the push button into the housing axially moves the cartridge relative to the pump unit and presses the cartridge against the pump unit so that the pump unit is activated for material dispensing. This configuration yields a simple actuation of the metering dispenser wherein no re gripping of the metering dispenser in the hand is required in order to apply the material, rather the push button is for example axially pressed into the housing with a thumb when receiving the dispenser in the hand and the metering dispenser gripped with the other fingers of the hand can be applied in a suitable manner to the skin of the user in order to apply the material thereon.

This axial movement of the push button yields a sensitive metering through actuating the push button through a finger of the hand since a controlled pressure build up onto the push button and thus a respective stroke of the cartridge and thus a desired precise metering application is provided.

According to the invention the housing of the metering dispenser is characterized as a central support element for direct and indirect support of all components of the metering dispenser in that the support element is provided with respective interface configurations for receiving and supporting components of the metering dispenser like pump unit, applicator, cover cap, push button and/or cartridge. For interface configurations press insertion fits, interlocking and/or clip connections are suitable which can be advantageously configured integrally in one piece at the plastic injection molded components without additional measures. It is appreciated that in case of the insertion press fit the diameter ratios between the component to be received, thus the diameter of the insertion sleeve of the pump housing and the diameter of the receiving sleeve of the housing are configured for a press fit and interlocking recesses or interlocking lugs that are complementary to interlocking configurations at the housing can be provided for an interlocking and/or clip connection and vice versa.

In particular it is advantageous to support the cartridge at the housing through the pump unit so it cannot be lost in that the pump unit is received with a press fit in the housing and advantageous the cartridge is received at the pump unit through an interlocking and/or clip connection. "Cannot be lost in the instant sense" means a firm support due to the interconnection wherein however due to the elasticity of the plastic configuration. Disconnection can also be disengaged again when a respective is applied.

In an advantageous manner the pump housing is provided as a ready to assemble unit with the cartridge and all relevant elements are provided in this unit which are required for the function of the metering dispenser. This unit can then be installed into the housing completely preassembled. This has the advantage that the function can be tested before the final assembly condition is achieved, thus before arranging the unit in the housing. When the interconnection of pump housing and cartridge with the pump elements included there in does not function this component is scrap and not the completely assembled metering dispenser with the housing. Thus it is advantageous that the unit is arrange able in a sleeve element of the housing through the press fit of the pump housing. It is furthermore advantageous in this context that the pump housing penetrates into the sleeve element of the cartridge with a sleeve and is secured through an interlocking lug at an interlocking shoulder at the sleeve element. Thus the cartridge is moveable relative to the pump housing in a pre assembled condition of the unit so that testing the function of the unit can be performed any time before mounting in the housing. Overall this arrangement provides a very simple configuration with rather few components which greatly simplifies assembly and fabrication.

Advantageously the push button is connected in a pressure transferring manner in a direction of the longitudinal axis of the housing with the cartridge that is moveably received in the dispenser housing, in particular through suitable interlocking and/or clip connections so that actuating the push button also moves the cartridge in order to activate the pump unit.

In the sense of the support constellation according to the invention, the applicator is advantageously arranged at one end of the housing opposite to the push button and the pump unit and the cartridge are arranged between these components.

The pump unit is advantageously configured so that it includes a self closing inlet valve which is formed in particular by a jacket made from rubber elastic and/or flexible material. When a vacuum builds up within the pump then the valve opens in that for example the jacket lifts off in upward direction from a piston arranged there under and an annular gap is formed through which material can exit in upward direction towards the applicator. Advantageously the pump unit also includes an outlet valve which is self closing in turn. For this purpose a spring with a closing head is advantageously provided in the pump housing wherein the spring configured as a compression spring presses the closing head onto an opening of the pump housing thus closing the pump unit in upward direction. Advantageously the closure head is formed by a ball, or a cone shaped closure element. When the cartridge is moved towards the pump unit due to the push button movement a pressure builds up within the pump unit as a function of the material wherein the pressure lifts the closure head off from the opening in order to put out material.

If material is then put out and the push button cannot be actuated any longer the cartridge can be pushed back into its starting position by an additional compression spring so that the closure head automatically runs over the preloaded compression spring back in a direction towards the opening in the pump housing so that the pump unit is closed again in upward direction towards the applicator.

A jacket made from rubber elastic or flexible material is suited as an inlet valve wherein the jacket is arranged in a sleeve that protrudes from the cartridge and is pressed against the cartridge by a sleeve of the pump unit. Thus the diameter of the jacket and thus the diameter of the inlet valve is greater than the diameter of the sleeve which also forms the ring cavity of the pump unit and thus the pump cylinder.

In an advantageous embodiment of the invention the push button is coupled with the cartridge through an interlocking connection. Thus the push button includes an insertion component at which an engagement lug is formed which can be brought into engagement with an interlocking recess or an interlocking shoulder of the cartridge which is configured with a respective undercut or configured complementary. Furthermore the cartridge advantageously includes at least one additional interlocking protrusion at its lower end that is oriented towards the push button wherein the interlocking protrusion engages an axial cavity provided at an inner wall of the housing wherein the axial cavity is configured as an annular cavity. Thus a drop out of the cartridge and/or the push button can be prevented in a simple manner. Advantageously the interlocking protrusion can also be configured at the push button which limits a lift stroke of the cartridge and due to the thrust coupling also limits a lift stroke of the push button in upward and in downward direction.

The pump unit itself is advantageously configured with a pump housing which is made from an upper sleeve and a lower sleeve, wherein a compression spring is received in the upper sleeve which compression spring is provided with a closure head and which closes the opening of a hollow piston of the pump housing which is arranged concentrically within the lower sleeve of the pump housing and which penetrates into an additional sleeve which is received in a sleeve element of the cartridge advantageously through a press fit or clamping fit. This sleeve which is received at the cartridge wherein the piston penetrates into the sleeve is coupled with the pump housing with a compression spring which indirectly also impacts the jacket of the inlet valve. This configuration provides a self acting closure of the valves. On the one hand side through the flexible configuration of the jacket which is arranged between the lower sleeve and the cartridge. The two springs at the pump housing which are advantageously configured as compression springs on the one hand side move back the cartridge and press the closure head of the upper outlet valve into the closure position.

In a particularly advantageously manner the metering dispenser is provided with an adjustment device which facilitates to lock the dispenser in a blocking position so that an accidental actuation of the push button cannot cause a material output and which facilitates transferring the dispenser into at least one functional position in which material can be dispensed when the push button is actuated or optionally into plural functional positions, so that various dosages of material output can be provided by the dispenser depending on the functional position to which the dispenser is adjusted.

Advantageously the adjustment device includes at least one lug which is arranged at the cartridge in particular at the protruding cartridge sleeve and which protrudes in a radial outward direction and at an inner wall of the housing receiving the cartridge a stop device is arranged which interacts with the lug so that the stop device limits a stroke position of the cartridge depending on the rotation position of the cartridge. This certainly also includes the stroke position 0 which is performed in the blocking position since the cartridge contacts a stop of the stop device at the housing with its lug so that the push button that is thrust connected with the cartridge cannot be pressed in, so that no material output can be provided. By rotating the push button or the cartridge a stroke can also be provided which can be metered in increments in another embodiment of the invention due to the stops being provided in steps. Thus depending on the configuration of the stops continuously variable metering is possible. Thus it is advantageous for continuous metering that the stop device includes plural stops so that in addition to the blocking position of the cartridge without any stroke plural strokes of the cartridge with different lengths are facilitated in a direction towards the pump unit. Instead of a lug at the cartridge also plural lugs can be provided wherein in particular a configuration of two diametrically opposed lugs at the cartridge, in particular at the sleeve protruding in upward direction from the cartridge are suitable.

However also the inverse arrangement is within the scope of the invention, this means the configuration of the lug or the lugs at the housing and the configuration of the stop device at the cartridge itself.

A respective adjustment in the blocking position or functional position is advantageously provided by turning the turning button which is advantageously connected torque proof with the cartridge through a suitable coupling device, in particular an interlocking lug engagement.

It is provided particularly advantageously that the different adjustment positions of the turning button and thus of the cartridge are interlockable so that an exact adjustment of the locking position or the functional position or the functional positions can be provided. Interlocking thus means that the interlocking position is disengage able for changing the adjustment position by respective pressure and rotation application or torque application onto the push button, so that the push button and thus the cartridge is adjustable to a desired other adjustment position for a desired stroke.

In order to provide the interlocking advantageously interlocking elements are provided at the push button, in particular with semi spherical interlocking protrusions, wherein the housing includes complementary engagement recesses in the lower portion in which the interlocking elements at the push button can engage. Due to the configuration of the components of the metering dispenser, in particular of the housing and the cartridge and the push button from a thermoplastic plastic material through injection molding a different adjustment in the interlocking positions can be performed due to the inherent elasticity of the material through applying a respective pressure.

BRIEF DESCRIPTION OF THE DRAWINGS

Subsequently advantageous embodiments of the invention are described based on the drawing figures which are only exemplary and do not limit the scope of the invention.

DETAILED DESCRIPTION OF THE PREFERRED EMBODIMENTS

Subsequently the embodiments of the invention are described in detail. It is appreciated that each described feature by itself is an independent feature irrespective of its context with other described features so that each feature independently from being an actual feature or an optional feature, as an independent feature by itself and/or in combination with other features can also be claimed independently.

Figures 1, 2:
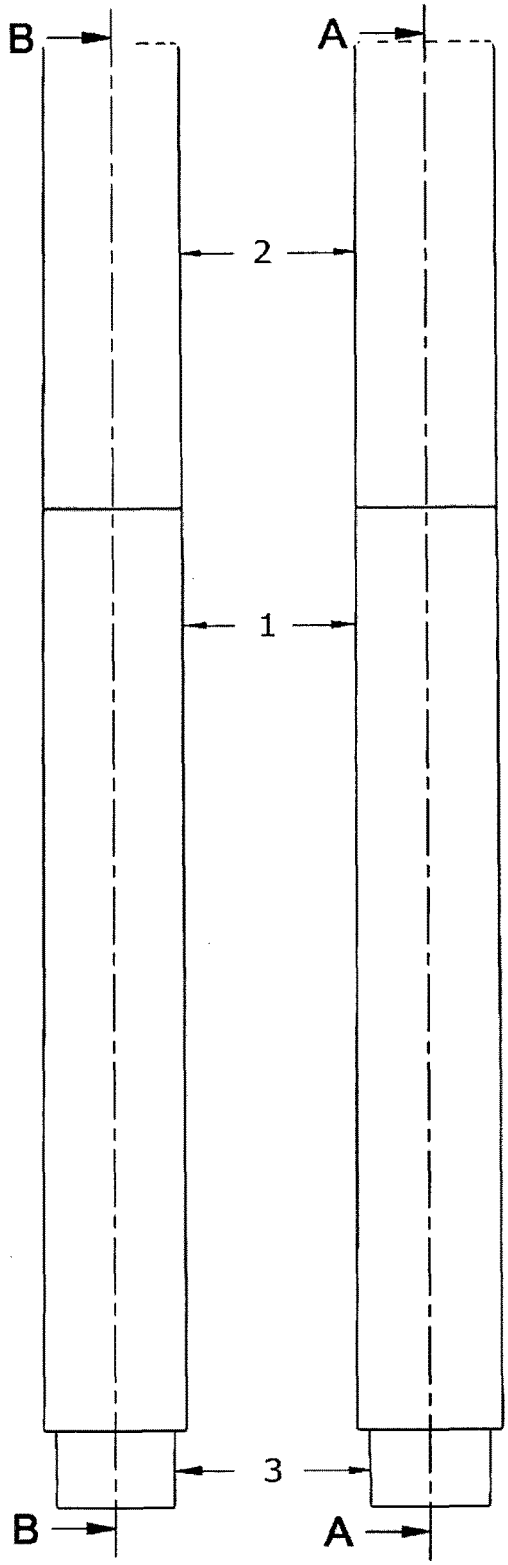
FIG. 1 illustrates a side view of a metering dispenser according to the invention in a first embodiment.
FIG. 2 illustrates a view of the metering dispenser that is rotated by 90°.
Figure 3:
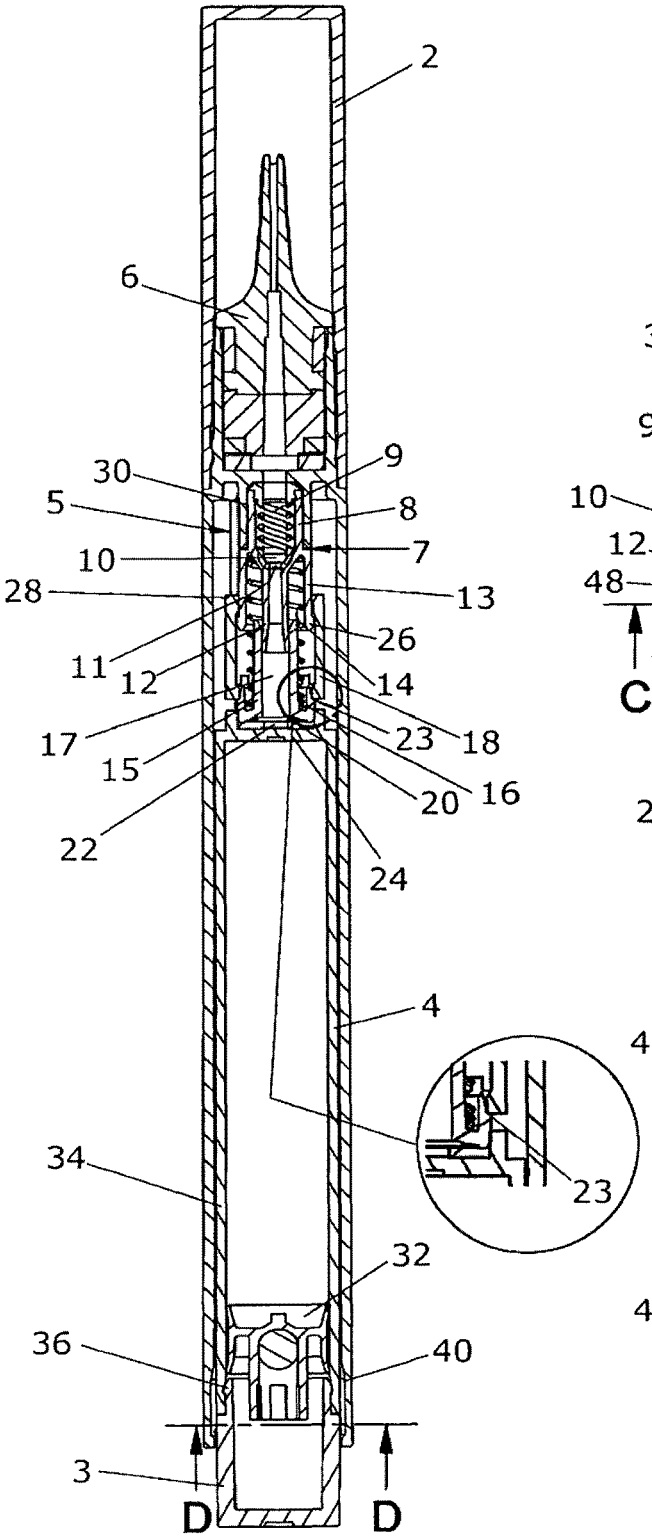
FIG. 3 illustrates a sectional view along the line A-A.
Figure 4:
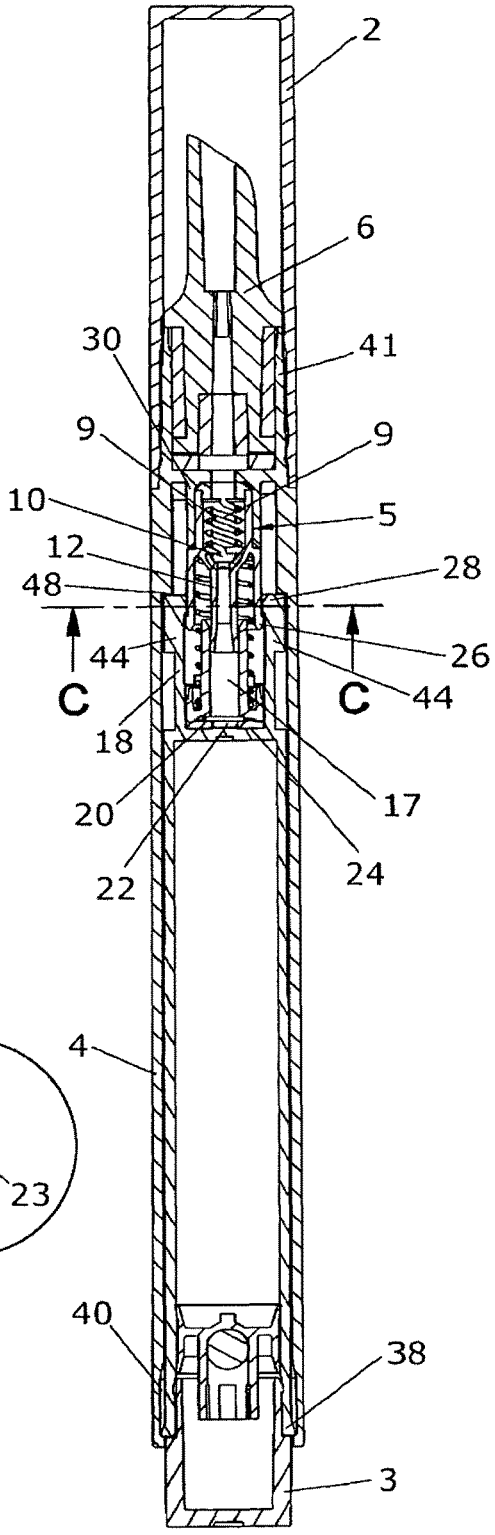
FIG. 4 illustrates a sectional view along the line B-B in FIG. 1.

The metering dispenser according to FIGS. 1-4 includes a housing 1 and a cover or cap 2, a push button 3 arranged at a lower end of the housing 1, a cartridge 4 received in the housing 1 for receiving the material to be put out, a pump unit 5 received in an interior of the housing 1, an applicator 6 arranged above the pump unit for applying the material wherein the applicator according to the illustration according to FIGS. 3 and 4 is enveloped by the applied cap 2. As illustrated in the figures the housing, the cap the cartridge and the push button are advantageously configured cylindrical. All known applicators can be used as applicators according to the invention without this being described in particular.

Figure 5:
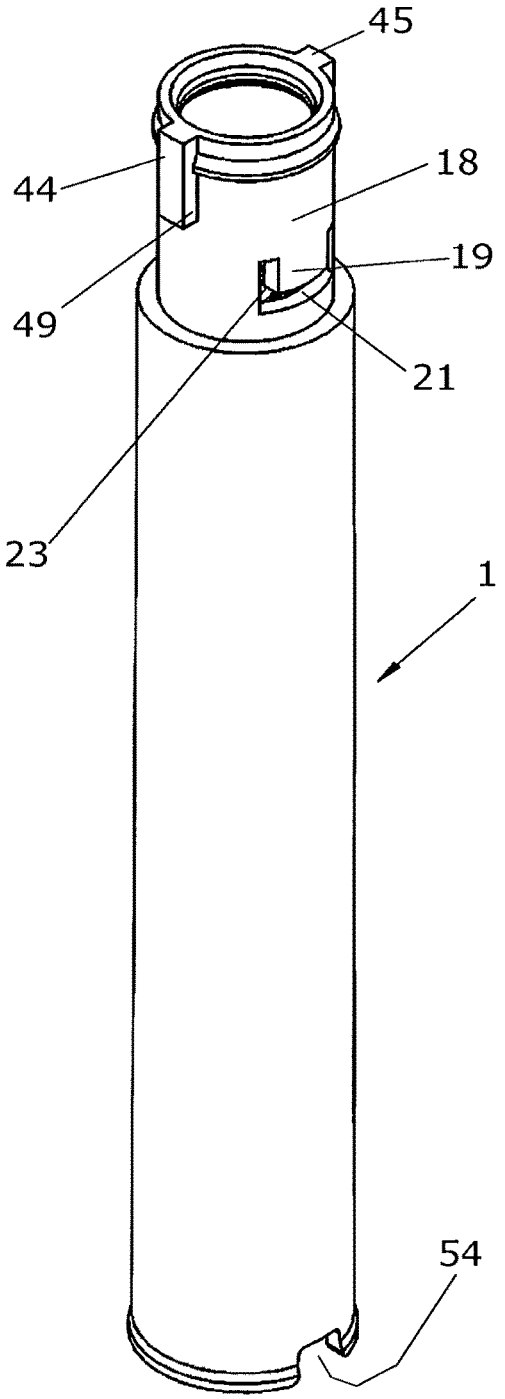
FIG. 5 illustrates a cartridge in a perspective view which cartridge is configured for receiving the material to be put out by the metering dispenser and which is used in the embodiments according to FIGS. 1-4.
Figure 8:
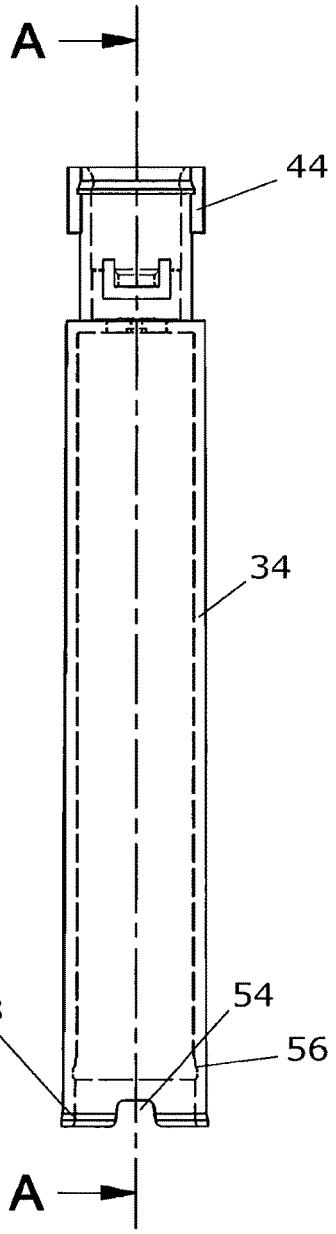
FIG. 8 illustrates a side view of the cartridge according to FIG. 5.
Figure 9:
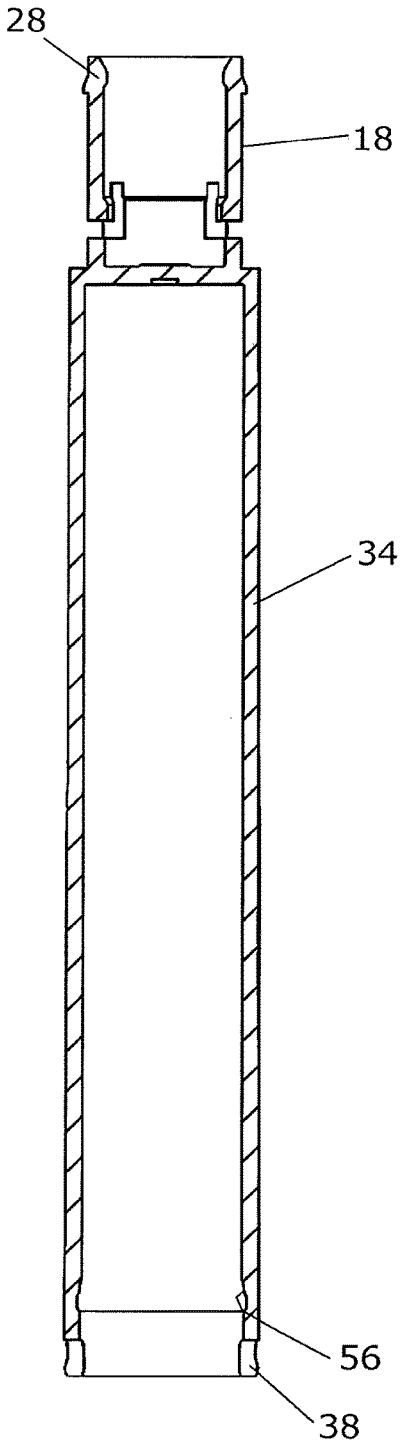
FIG. 9 illustrates a sectional view along the line A-A of FIG. 8.
Figure 10:
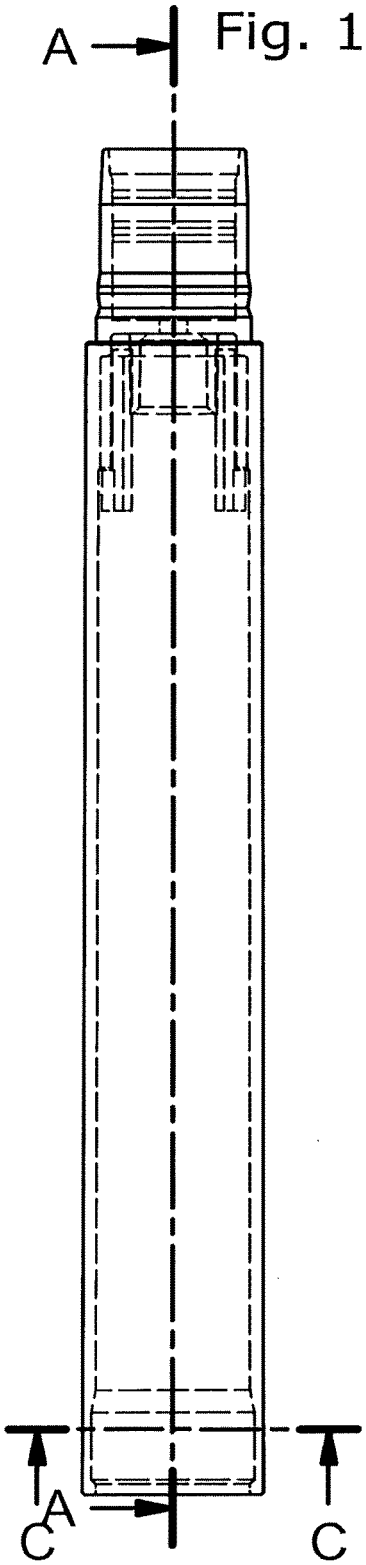
FIG. 10 illustrates a view of the housing of the metering dispenser receiving the cartridges according to FIG. 5, wherein the metering dispenser is used for FIGS. 1-4.

The cartridge for receiving the material is evident in the perspective view from FIG. 5 and in a sectional view from FIGS. 8 and 9. The pump unit is illustrated most clearly and FIGS. 3 and 4. It is formed from a pump housing 7 which is integrally made in one piece by itself like the other components described supra advantageously made from plastic material in particular through injection molding.

The pump housing 7 includes an upper sleeve section 8 in which a spring 9 is received which is advantageously made from plastic material, wherein a closure element configured as a valve 10 is arranged at a lower end of the spring 9. The closure element can be advantageously configured integrally into one piece with the spring 9 and closes an opening 11 of the pump housing 7 wherein a downward extending hollow piston adjoins the opening 11 wherein the hollow piston is advantageously configured as an integral component of the pump housing 7.

Advantageously the pump housing 7 is received with its sleeve section 8 inserted into a sleeve element 30 at an annular shoulder protruding inward from the housing 1, thus advantageously with a press fit.

The pump housing 7 furthermore includes an integrally configured and downward extending sleeve 13 which defines an annular cavity for receiving a compression spring 14 together with the hollow piston 12. The hollow piston 12 according to the illustrations in FIGS. 3 and 4 penetrates a sleeve 15 which includes an annular flange 16 at a lower end in which annular flange the lower end of the compression spring 14 is received and which forms an annular cavity 17 together with the piston 12 and thus the pump cylinder 17.

The sleeve 15 and the annular flange 16 are arranged in an upward protruding sleeve element 18 of the cartridge 4 thus advantageously with a press fit of the annular flange 16 in the protruding cartridge sleeve 18 and they contact a jacket 20 made from advantageously rubber elastic material. In another advantageous embodiment the sleeve 15 when the sleeve 15 is supported within the sleeve element 18 of the cartridge by a suitable interconnection as evident best from FIGS. 3 and 5. FIG. 5 illustrates at least one clamping arm 19 formed at the sleeve element 18 configured by a U shaped opening slot 21 in the sleeve element 18. When injection molding the cartridge 1 with the one piece sleeve element 18 the U shaped slot 21 is formed by a respective tool with a slide. This configuration facilitates that the clamping arm 19 can be configured with a respectively undercut surface or shoulder 23 which protrudes sufficiently into an interior of the sleeve element 18 and which extends substantially perpendicular to the longitudinal axis of the housing and of the metering dispenser and which forms a very effective interlocking connection with the face end of the annular flange 16 which prevents a disengagement of the pump unit from the sleeve 15 and thus also from the pump unit 7 even when high pressures are applied. This can be easily implemented by a strong undercut of the clamping element 19 which is very advantageous for the stable interconnection between sleeve element 18 and sleeve element 15. In the illustrated embodiment two clamping arms 19 are configured diametrically opposite at the sleeve element 18. In the illustrated embodiment the jacket 20 has a central opening 22 which correlates with an opening of the upper terminating base of the cartridge 4 which opening is not illustrated and used for putting out the material during the pump stroke as will be described infra. The jacket 20 forms the inlet valve of the pump and is self-closing under normal pressure conditions due to the flexible material. For example a piston that closes the jacket opening 22 can be attached below the jacket wherein the piston closes the opening 22. If a vacuum builds up above the jacket the jacket bends upward in the portion of its opening so that an annular gap is formed for the material input between the piston and the jacket.

In the illustrated embodiment according to FIGS. 3 and 4 the cartridge 4 is advantageously integrally configured with the upward protruding sleeve element 18 and for example advantageously supported by the pump unit 7 within the housing 1.

As evident from FIGS. 3 and 4 the sleeve 13 of the pump housing has an interlocking lug 26 at its lower end which penetrates the sleeve element 18 of the cartridge 4 wherein the interlocking lug is advantageously circumferentially extending and radially outward protruding and reaches behind a radially inward oriented interlocking shoulder 28 of the sleeve element 18 and additionally supports the cartridge through an interlocking or clip interconnection within the housing 1. Thus the cartridge and the pump housing 7 and interconnected to form a unit which can be arranged in the housing 1 in assembled condition. This has the advantage that the function of the pump and cartridge can be checked after assembly before inserting the unit into the housing and not only after assembly in the housing. In case there is a malfunction only the unit formed by the pump housing and the cartridge is scrap. Though the cartridge and the pump housing are arrange able as a unit in preassembled position in the housing however the connection of cartridge and pump housing is advantageously configured so that the cartridge is moveable relative to the pump housing to provide the actuation stroke of the pump. This is advantageously provided by penetrating a sleeve of the pump housing into a sleeve element of the cartridge. The pump unit 7 itself is in turn supported by a press fit at the housing 1 thus within a downward extending sleeve element 30 in the housing 1 which has a slightly smaller diameter than the sleeve shaped section 8 of the pump unit. Alternatively certainly also another suitable and/or clip connection can be provided. In so far the pump unit is configured at the housing 1 as well as the cartridge. Certainly also another fixation is feasible in that the cartridge is fixated at the housing 1 through an interlocking and/or clip connection and additionally the pump unit is fixated in the housing which pump unit is arranged above the cartridge.

Figure 13:
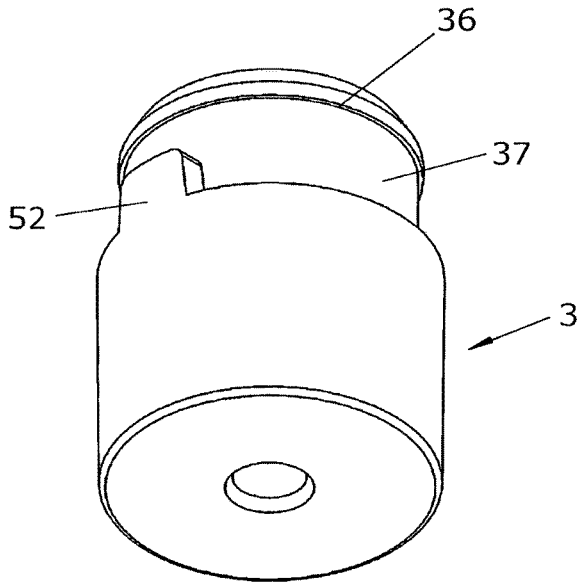
FIG. 13 illustrates a perspective view of an embodiment of a push button as it is used in the embodiment according to FIGS. 1-4.
Figure 14:
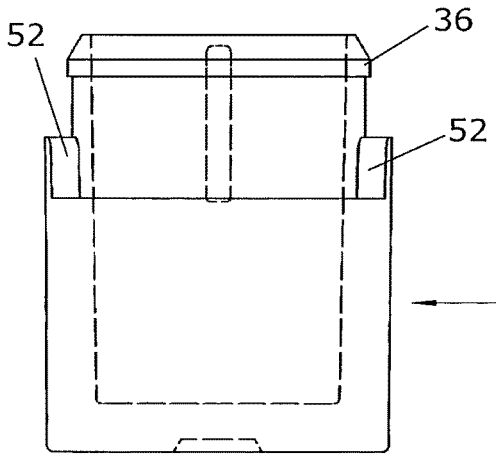
FIG. 14 illustrates a side view of the push button illustrated in FIG. 13.
Figure 15:
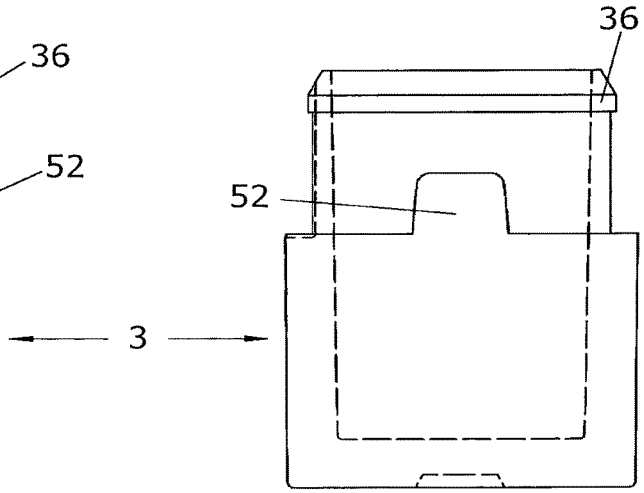
FIG. 15 illustrates a side view of the push button that is rotated by 90° relative to the position according to FIG. 14.
Figure 16:
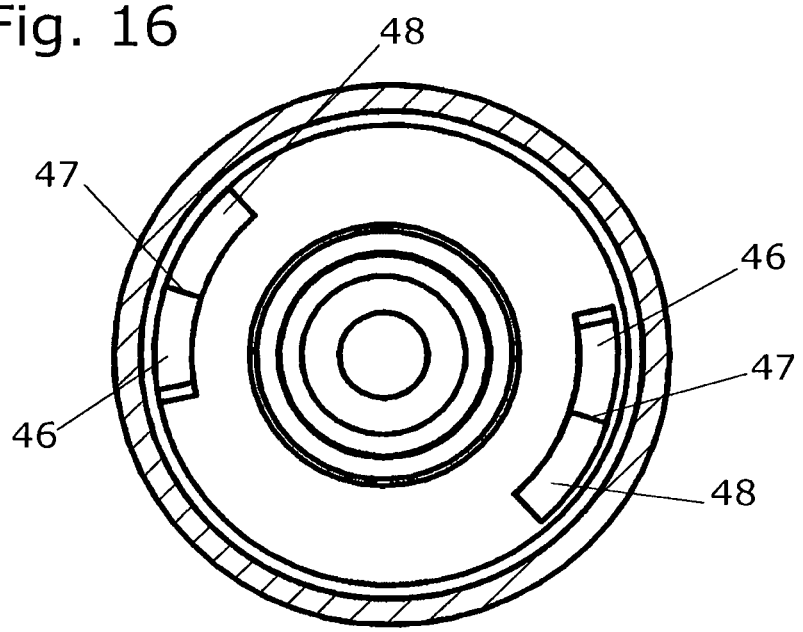
FIG. 16 illustrates a sectional view of the housing illustrated in FIG. 10 along the line C-C of FIG. 10 in a slightly enlarged illustration.
Figure 17:
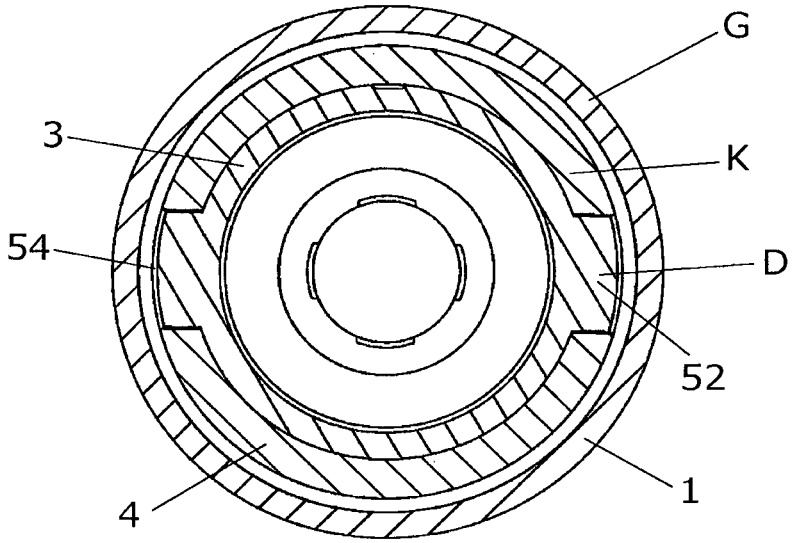
FIG. 17 illustrates a sectional view of the metering dispenser according to FIG. 3 cut along the line D-D in a slightly enlarged view.
Figure 18:
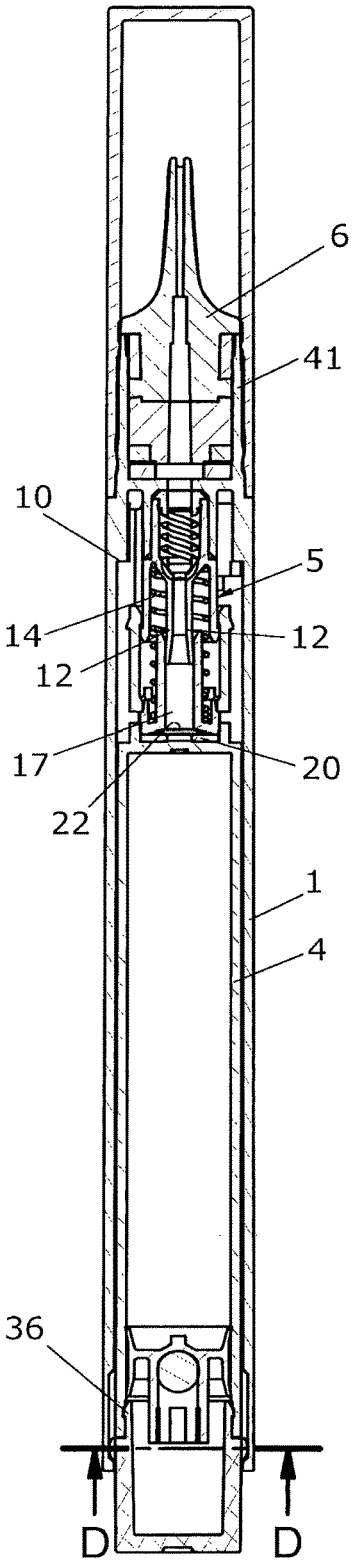
FIG. 18 illustrates a sectional view of another embodiment of a metering dispenser.
Figure 19:
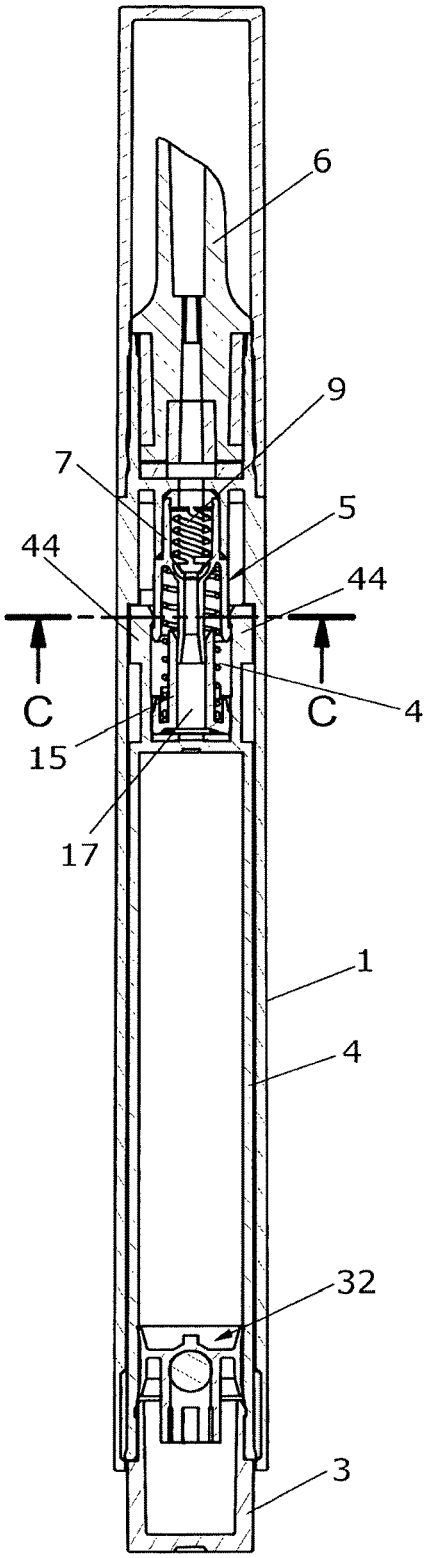
FIG. 19 illustrates an analog sectional view of the metering dispenser illustrated in FIG. 18 however rotated by 90°.
Figure 20:
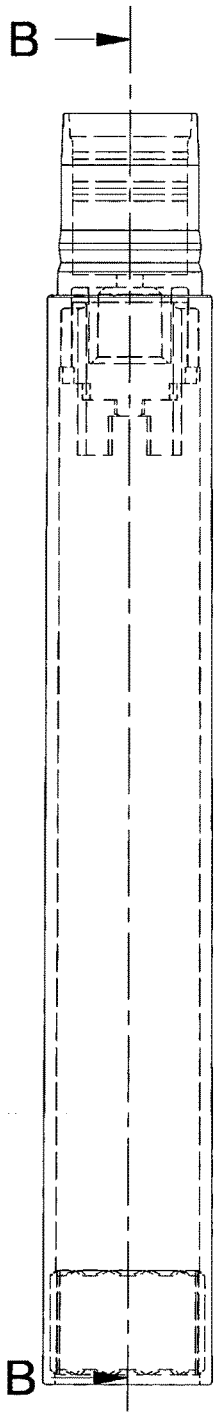
FIG. 20 illustrates a side view of the housing used for the metering dispenser according to FIGS. 18 and 19.
Figure 21:
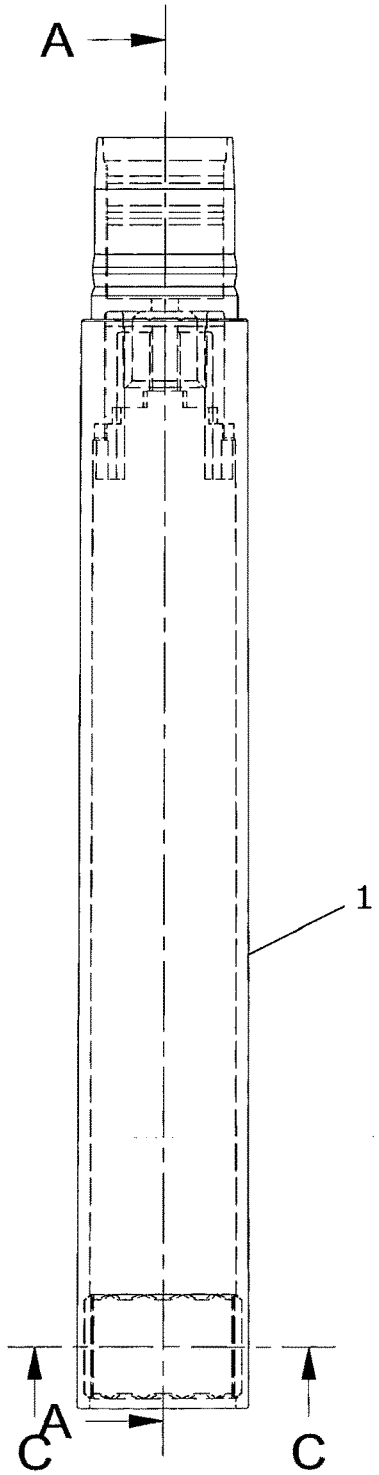
FIG. 21 illustrates a side view of the embodiment of the housing according to FIG. 19 that is rotated by 90°.

As apparent from FIGS. 3 and 4 the cartridge is provided at its lower end with a piston 32 that is inserted therein and which has a known configuration wherein the piston is inserted into the cartridge container that is open at a bottom after filling the component into the cartridge that is be put out. The piston 32 has a suitable configuration and seals the cartridge container 34 in downward direction. A piston according to the configuration of DE 20 2010 011 248 U1 is particularly suitable wherein a seal film from the material filled into the cartridge 4 forms with the first pump strokes in the annular gap between the piston 32 and the inner wall of the cartridge container 34 which provides a correct sealing of the material within the cartridge in a simple manner wherein the piston moves upward towards the pump unit in a self acting manner when building up a vacuum and putting out the material. Below the piston or at a lower end of the housing 1 the push button 3 is arranged thus due to a inserted fit at the inner wall of the cartridge container 34 and by a suitable interlocking and/or clip connection which is also evident from FIGS. 3 and 4 at 36. Additionally the push button according to FIGS. 13-15 includes a sleeve shaped insertion element with an upper advantageously circumferential interlocking lug 36 which is interlock able with a complementary recess 56 at a lower end of the cartridge, FIGS. 8 and 9. It is further evident from FIGS. 3 and 4 that the cartridge container is advantageously received at its lower end with at least one, thus advantageously circumferential interlocking shoulder 38 which protrudes in outward direction and which is received in an axial cavity 40 of the housing 1 which supports the cartridge 4 in the housing. Advantageously a respective interlocking protrusion can also be formed at the push button 3 which interlocking protrusion engages the cavity 40 and thus secures the push button and the cartridge against falling out. It is appreciated that plural offset interlocking protrusions can also be provided.

The applicator 6 is also made from plastic material through injection molding and produced in a known manner and is supported with a press fit in an upward extending sleeve 41 of the housing 1 and supported therein with the press fit. The cover 2 is slid over and also advantageously supported through an interlocking connection and/or clip connection relative to the upward protruding sleeve 41 of the housing 1 as apparent from FIGS. 3 and 4.

Based on this configuration the metering dispenser functions as follows:

When the push button 3 is manually impressed in a direction towards the housing 1 in upward direction the cartridge is also moved in upward direction towards the pump unit which moves the sleeve 15 upward within the sleeve element 18 of the cartridge so that the annular cavity 17 defined by the sleeve 15 and the hollow piston 12 penetrating therein is reduced in volume or the hollow piston 12 moves so the speak into the annular cavity for the pump cylinder 17. Simultaneously the spring 14 is compressed and preloaded. When the push button 3 is released the cartridge and also the push button 3 are moved downward due to the spring effect 14 which establishes a vacuum as a matter of consequence within the annular cavity 17. Due to the vacuum the jacket 20 opens and material flows from the cartridge 4 and penetrates the annular cavity 17. When actuating the push button 3 in upward direction and moving the cartridge 4 in a direction of the applicator or the pump unit 5 a pressure builds up within the annular cavity 17 that becomes smaller so that the spring preload of the spring 9 is overcome and the closure head 10 of the spring lifts off from the opening 11, thus the valve opens and the material is put out through the opening 11 through the hollow piston 12 in outward direction towards the applicator. This push button actuation causes a pump stroke with a respective material output. When the push button is released again the cartridge moves downward due to the spring load and a vacuum is established in the annular cavity 17 which is in turn filled again with material from the cartridge. Simultaneously the piston 32 is also advanced with each pump stroke until the cartridge 4 is emptied completely.

This means simple actuation of the push button in a direction of the longitudinal axis of the dispenser housing causes a metered material output in a reliable and safe manner through the applicator 6.

Eventually in order to prevent unintentional actuation of the push button 3 and thus an unintentional output the embodiment according to FIGS. 1-4 can employ additional measures, in particular it can be provided with an adjustment device. As evident best from FIG. 5 the sleeve element 18 of the cartridge 4 includes a radially outward extending rib shaped lug 44 wherein diametrically opposed lugs 44 are provided in the illustrated embodiment 2 wherein the lugs protrude in outward direction. This embodiment is advantageous but does not limit the invention, only one lug or more than 2 lugs can be provided as required.

Figure 6:
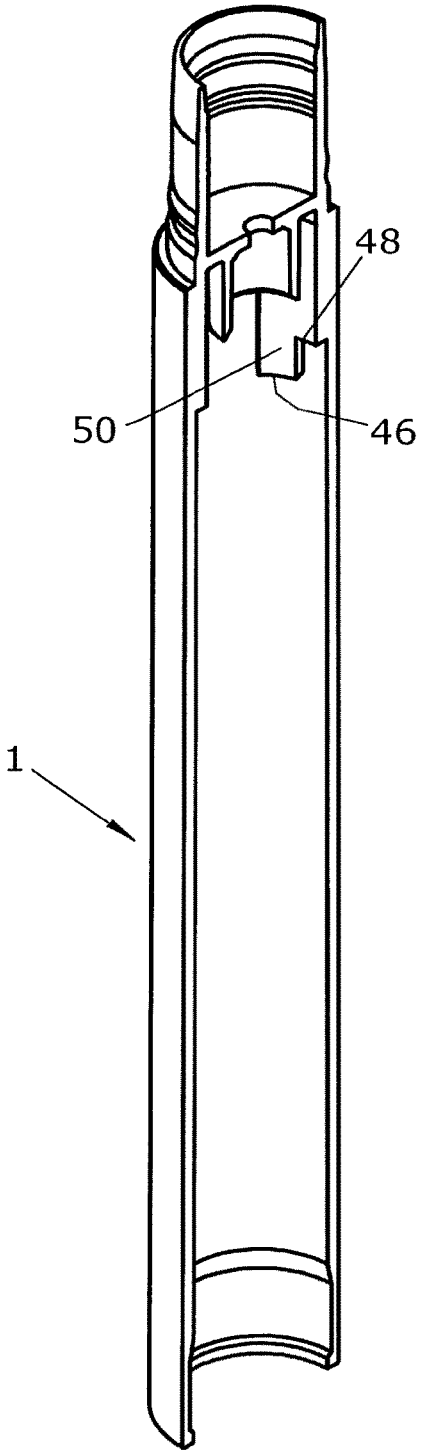
FIG. 6 illustrates a perspective view of the housing for receiving the cartridge according to FIG. 5 in a sectional view.
Figure 11:
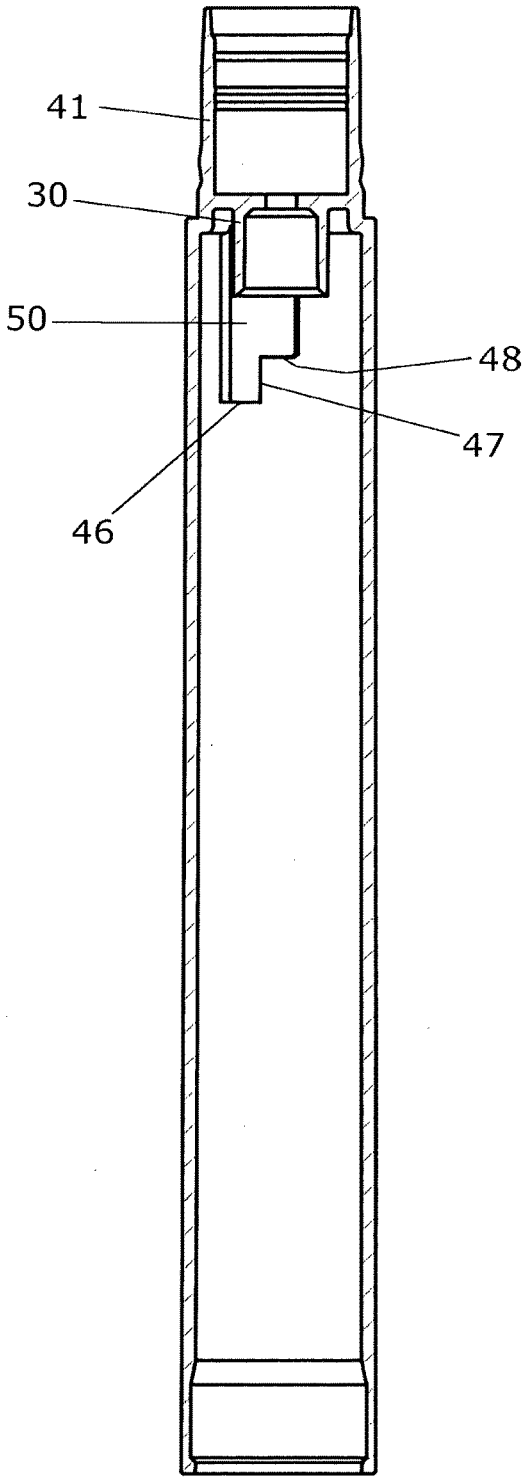
FIG. 11 illustrates a sectional view along the line A-A according to FIG. 10.
Figure 12:
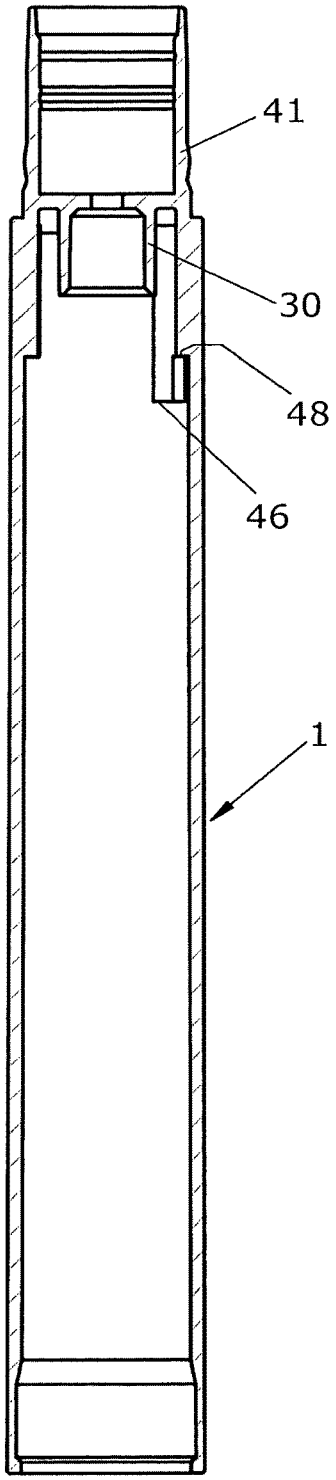
FIG. 12 illustrates a sectional view of the housing in a position that is rotated by 90° relative to the position according to FIG. 11.

Corresponding to the lugs 44 as evident best from FIGS. 6, 10-12 and 16 two stops 46 and 48 are provided at different elevations at the housing 1 and its upper end below the housing sleeve 41 wherein the lugs are evident best from FIGS. 6 and 11 and are connected with one another by a stop shoulder 47. These stops 46, 47 and 48 are arranged in a stair configuration at a stair shaped wall of the dispenser housing 1 which stair shaped wall slightly protrudes inward in a radial direction. This stair shaped wall is designated as 50 as evident from FIG. 16 the stops 46, 47 and 48 are diametrically arranged according to the diametrically opposed arrangement of the lugs 44, wherein the lugs 44 respectively include an upper contact surface 45 and a lateral contact surface 49 for an interaction with the stops of the stair case wall 50 as will be described infra.

In the illustration according to FIG. 4 the upper surface 45 of the lug 44 (c.f. also FIG. 5) contacts the upper contact surface 48 of the housing and with one of their lateral surfaces 49 contacts the shoulder 47 so that an actuation, this means an impression of the push button 3 in this position in upward direction is not possible thus even when the push button 3 is actuated by accident. The metering dispenser is in a blocking position and material output in this position, this means in the locking position for the cartridge is not possible.

However when the push button 3 is rotated by a predetermined angle in a direction away from the stop shoulder 47 of the wall 50 and thus also the cartridge 4 is rotated within the housing 1 due to a provided form locking or torque proof connection between the push button 3 and the cartridge 4 then both lugs 44 come out of engagement with the locking stops so that in this rotational position of the push button and the cartridge 4 the push button can be pressed in upward direction and thus the cartridge 4 can be moved in upward direction against the pump unit 7 in order to provide material output. Any engaging connection like e.g. a connection according to the key and groove principle is suitable for torque proof interconnection between the cartridge and the push button 3.

Advantageously the anti-locking position and the functional position, this means the pumping position or the lift position of the cartridge can be displayed for the user at the dispenser housing 1 from an outside which can be provided by suitable measures, like e.g. a scaling or a side window or similar.

Figure 7:
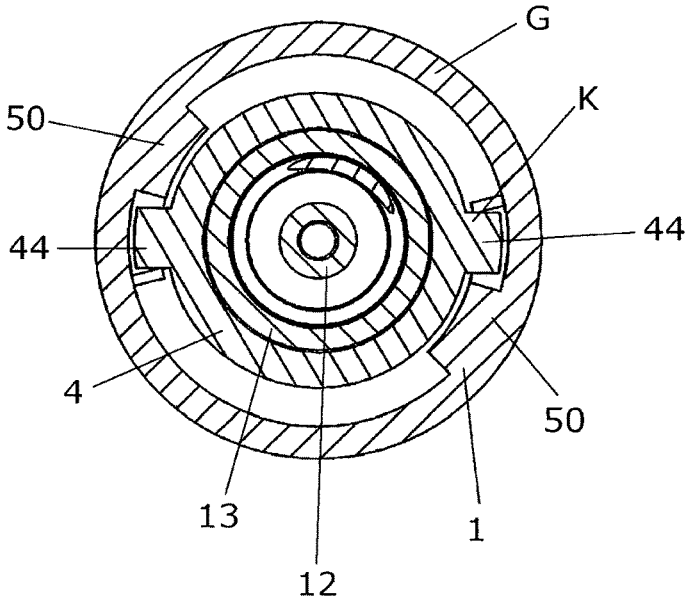
FIG. 7 illustrates a sectional view along the lines C-C of FIG. 4 in a slightly enlarged illustration.

Thus it is provided in a simple manner that unintentional actuation of the metering dispenser is not possible so that a helpful safety measure against unintentional output of the material is provided. FIG. 7 illustrates the blocking condition for the cartridge that is evident from FIG. 4.

FIGS. 13-15 and FIG. 17 eventually illustrate the torque proof interconnection between the push button 3 and the cartridge 4 of an exemplary and advantageous embodiment. As evident from FIGS. 13-15 the push button 3 includes at least one but advantageously two diametrically opposed and axially protruding lugs 52 configured as ribs which engage corresponding recesses 54 at a lower end of the cartridge container 34 after inserting the push button 3 into the cartridge 4 so that a torque proof connection is provided between the push button and the cartridge 4 wherein the torque proof connection facilitates from the locking position into a functional position and vice versa. In the engagement position of the lugs 52 in the recesses 54 an axial interlocking with the cartridge is facilitated due to the interlocking lug 36 wherein the cartridge has a corresponding advantageously circumferential bead 56 for this purpose at the inner wall of the cartridge container 34. Thus the interlocked insertion fit which is disengageable due to the elasticity of the component when a sufficient force is applied is provided so that the push button is axially securely supported at the housing 1 by the cartridge and connected torque proof with the cartridge due to the engagement position of the lugs 52 in the recesses 54.

It is certainly within the scope of the invention to provide suitable other fixations between the turning button and the cartridge like for example also a reverse arrangement of the stair configuration in cooperation with the lugs 44 and the cartridge, this means the stair shaped stair wall at the cartridge and the lugs at the housing this means they can be provided at the inner wall. Certainly also any other suitable actuation device is feasible for interlocking and transferring the cartridge into the functional position for the material output instead of the described stops cooperating with the lugs 44.

FIGS. 18-24 illustrate another embodiment which is configured similar to the preceding embodiment but facilitates plural stroke positions for the cartridge 4 relative to the simple on off configuration in the embodiment according to FIGS. 1-4 with only one interlocking position and only one stroke position in order to facilitate differently metered output volumes as a function of the adjusted position.

Figure 22:
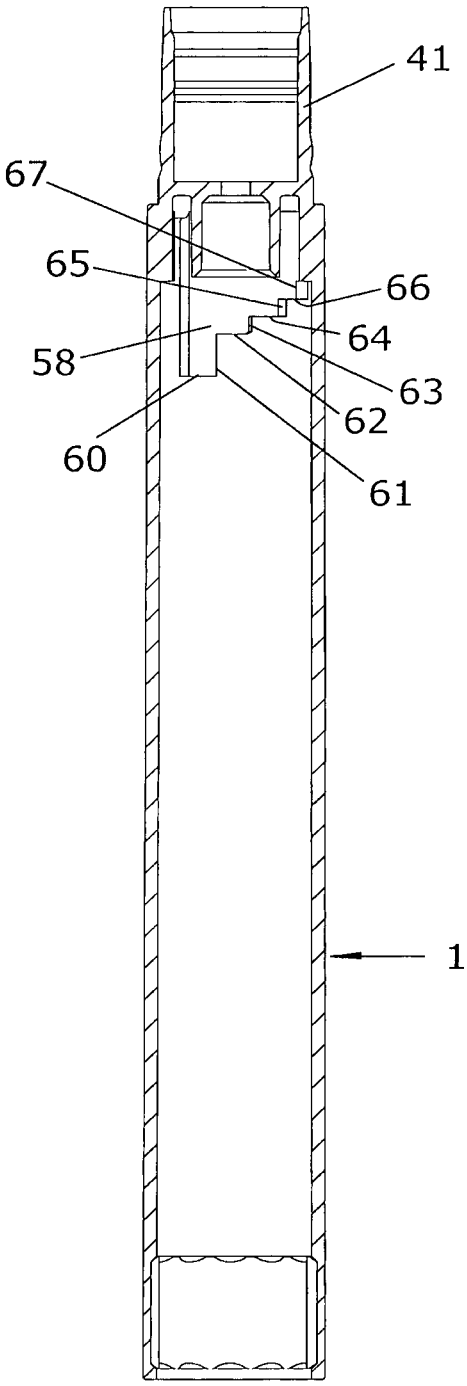
FIG. 22 illustrates a sectional view of the housing illustrated in FIGS. 20 and 21 along the sectional line A-A.
Figure 23:
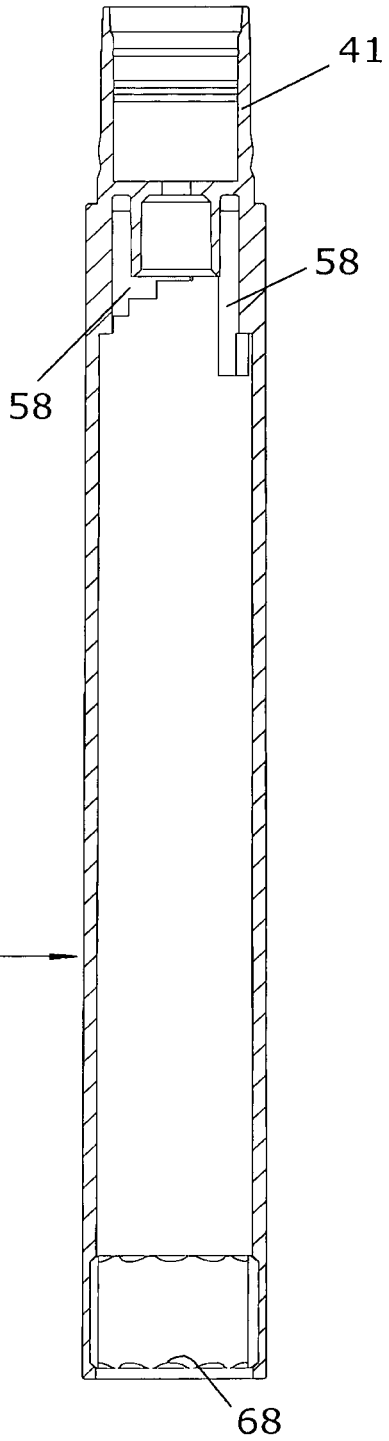
FIG. 23 illustrates a sectional view along the line B-B that is rotated by 90° relative to the view of FIG. 22.
Figure 24:
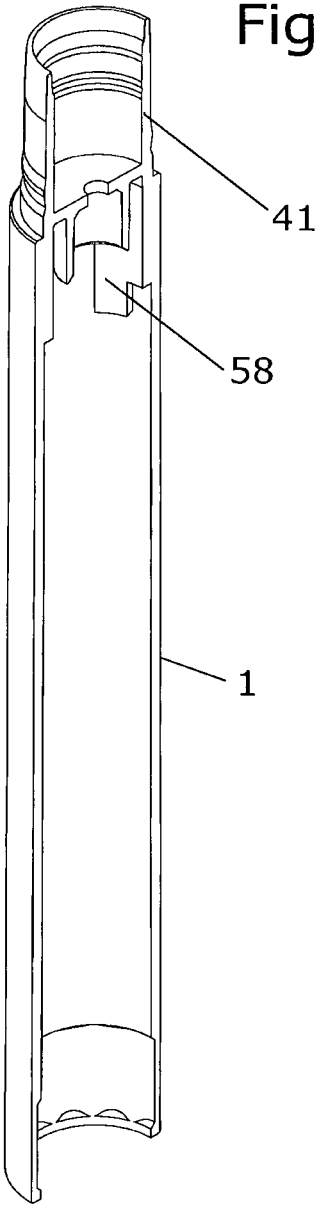
FIG. 24 illustrates a perspective view of the housing according to FIGS. 20-23 in a partial view.
Figure 25:
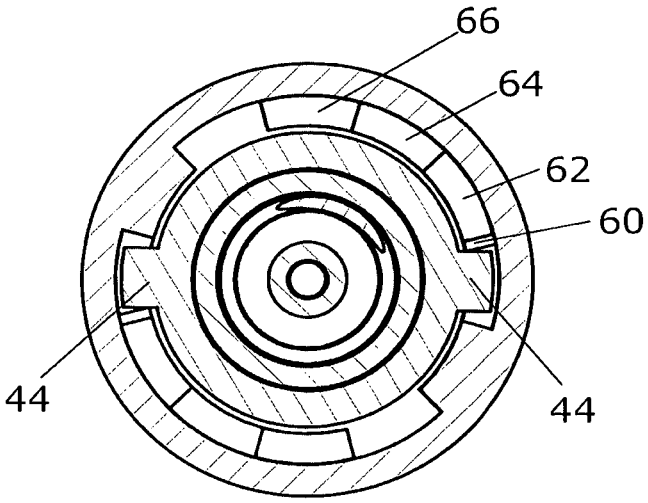
FIG. 25 illustrates a sectional view of the metering dispenser according to FIG. 19 along the line C-C in a slightly enlarged view.

Thus, the housing 1 includes a stair shaped wall configuration 58 with plural stops 60, 62, 64 and 66 and corresponding lateral stop shoulders 61, 63, 65 and 67 operating analogously to the already described embodiment as evident from FIGS. 22, 23 and 25. Thus as evident from FIGS. 23 and 25 to diametrically opposed stair wall configurations with respective stops are provided.

This yields strokes with different lengths and thus applied volumes with different dosages so that depending on a rotational position of the push button 3 and the cartridge 4 connected torque proof therewith a fine metering according to client specifications is provided. Accordingly it would be possible to perform a 100% stroke, thus according to an actual embodiment of a dispenser with a stroke length of 5 mm and then eventually a stroke of 75%, 50% and for example 25% as a function of the rotating position so that accordingly incremental lower application volumes can be provided as a function of a position of the contact lugs 44 relative to the contact surfaces 60-66.

The adjustment or alignment of the lugs 44 to the suitable contact surfaces 60-66 is performed in turn through a respective rotation of the rotating button 3, wherein the desired lift position can be indicated by a respective scale or other indicators at the dispenser housing.

According to another advantageous embodiment the individual rotational positions can be interlocked wherein for example as illustrated in FIGS. 26-28 and 33, 34 respective housing recesses 68 can be provided as provided herein at the lower end of the housing 1. These recesses 68 are provided for an engagement position with respective interlocking configurations in the push button.

Figure 26:
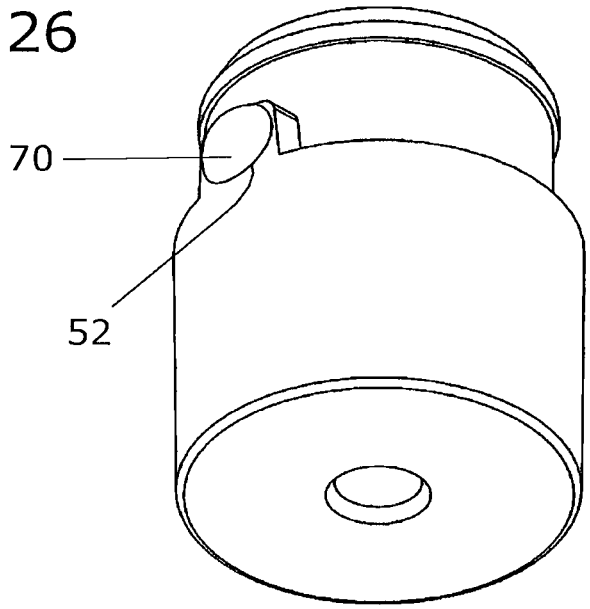
FIG. 26 illustrates a perspective view of the push button.
Figure 27:
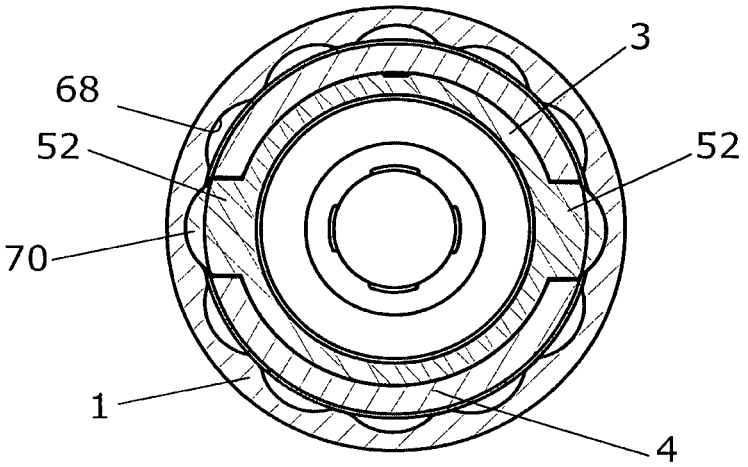
FIG. 27 illustrates a sectional view of the metering dispenser along the line D-D in FIG. 8.
Figure 28:
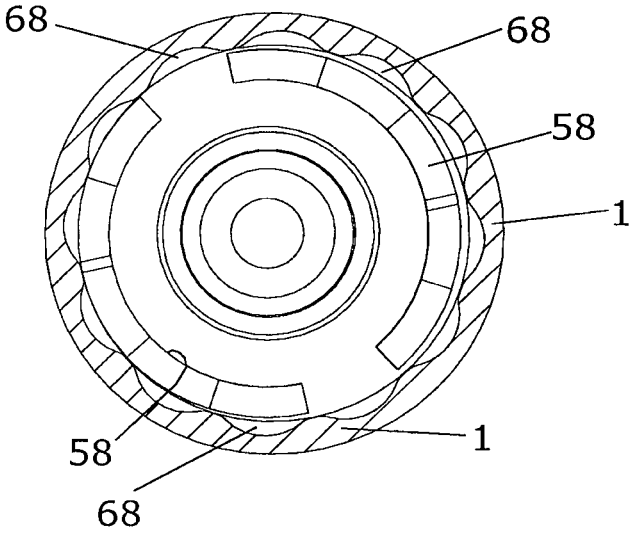
FIG. 28 illustrates a sectional view of the metering dispenser along the line C-C of FIG. 21.
Figure 33:
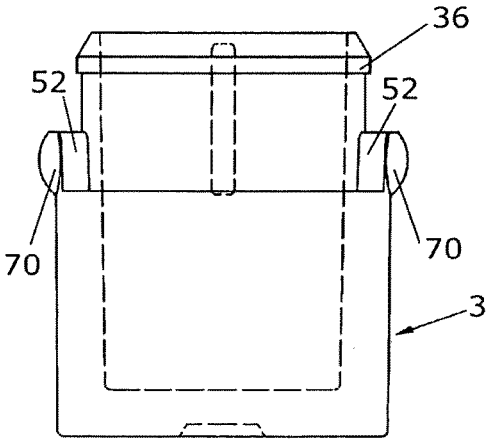
FIG. 33 illustrates a side view of the push button illustrated in FIG. 26.
Figure 34:
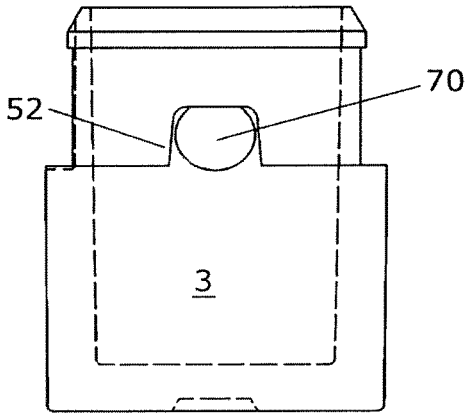
FIG. 34 illustrates a 90° rotated side view of FIG. 33.

A respective embodiment of a push button of this type is illustrated in FIGS. 26, 33 and 34. This push button differs from the push button illustrated in FIGS. 13-15 only in that semi spherical protrusions 70 or other suitable interlocking members are provided on the axially upward protruding lug or lugs 52 wherein the interlocking members are protruding in a radially outward direction and as apparent in particular from FIG. 27 are interlockable in respective rotational positions in the recesses 68 in the housing which are respectively configured in a complementary manner. It is appreciated that as a function of the number of the rotational positions or the cartridge strokes caused thereby including the blocking position a corresponding number of interlocking recesses 68 is provided in the housing so that a corresponding interlocking safety between the turning button 3 and the housing 1 is provided for each turning position defined for a particular cartridge stroke length and in the blocking position. These interlocking positions are certainly configured so that a desired manual rotation of the turning button is possible into the other rotational positions when a force is applied. This facilitates handling, renders adjusting the respective turning strokes reliable and can be easily checked by a user. Furthermore this yields the advantage that the rotational positions of the push button are defined by the interlocking engagements and are easily determinable for a user in an acoustic manner through an engagement click. The view from below in FIG. 28 also shows the association of the stop surfaces or stops of the two stair walls 58 with the recesses or bulges 68 in the housing 1.

The described components and structural elements are certainly not limited to the pump unit described herein and they can also be implemented for other pump units. Though the housing the cartridge and the other associated components are essentially configured cylindrical, in particular with a circular cylindrical cross section. It is within the scope of the invention to use also other cross sections, e.g. polygonal cross sections and square profiles. As a result a slender metering dispenser is obtained that handles very comfortably and which facilitates precise metering of the material to be put out thus with very simple components of the metering dispenser which can be connected very quickly through plug in connection to form the metering dispenser.

Figure 29:
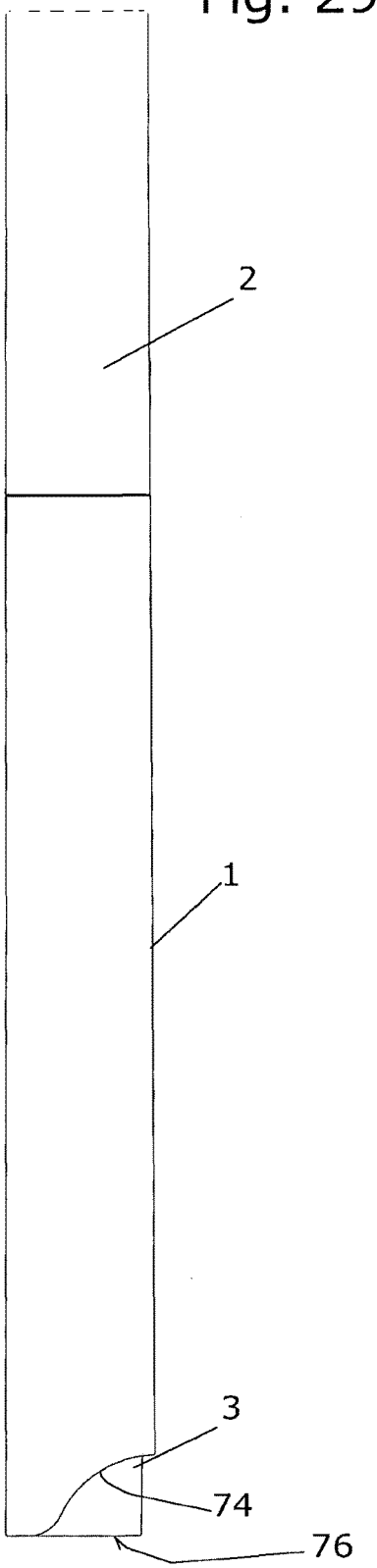
FIG. 29 illustrates a side view of a third embodiment of the metering dispenser.
Figure 30:
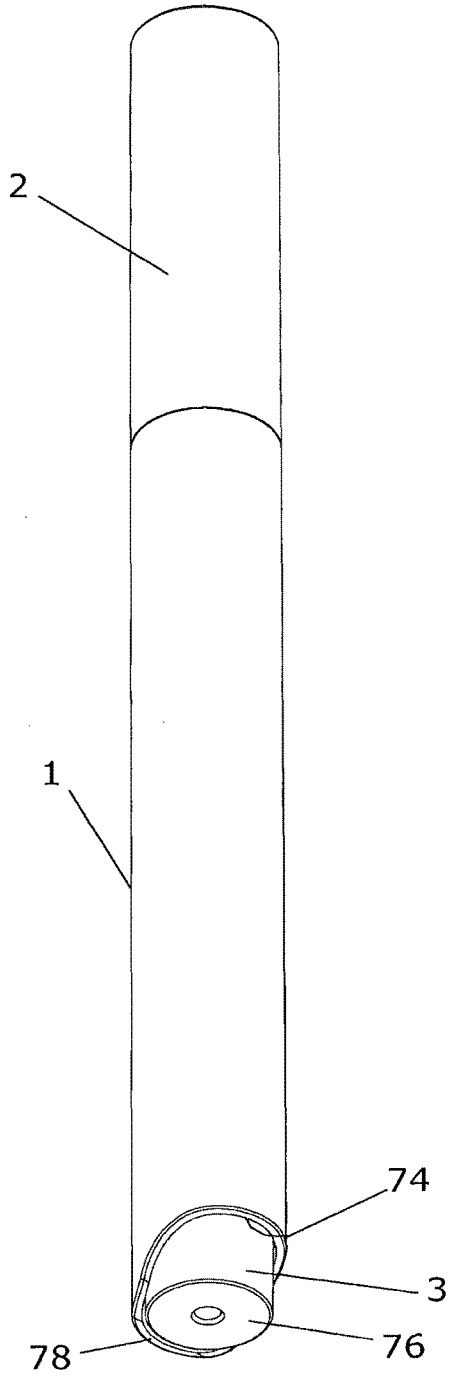
FIG. 30 illustrates a perspective view of the metering dispenser illustrated in FIG. 29.

FIGS. 29 and 30 illustrate an additional embodiment of a metering dispenser with a housing 1 and a cover 2 placed thereon and a push button 3 arranged at another end of the housing element. As a difference to the preceding embodiments however the recess 74 of the lower end of the housing 1 which is wave shaped in the side view of FIG. 29 partially envelops the push button 3 and partially relieves the push button 3. Thus the push button 3 is easy to activate in that it is pressed upward from below as it is the case also in other embodiments. A safety against unintentional impression of the push button 3 and thus of an unintentional material output is implemented in that instead of the lateral relieving of the push button 3 the housing extends with a lower end relative to the side of the relieving of the push button in downward direction up to the base 76 of the push button so that the lower end 78 of the housing 1 illustrated in FIG. 29 on the left due to the flush arrangement with the push button base 76 prevents thus when placing the metering dispenser onto a placement surface that the push button is impressed. An actuation is only possible when the push button is actuated in a controlled manner axially from below. Depending how much the push button 3 is enveloped or the smaller the exposed surface of the push button is towards the side, the stronger is the safety function against unintentional actuation of the push button 3. Besides that the configuration of the metering dispenser according to the embodiment according to FIGS. 29 and 30 is identical to the embodiment described supra.

It is advantageous that the components of the metering dispenser are produce able from plastic material through injection molding and the provided safety measures or stroke settings as a matter of principle do not require any additional components but can be configured at the existing basic components. This yields a configuration which is also advantageous for a mass production of the metering dispensers. Simultaneously a simple assembly of the components forming the metering dispenser is provided.

Figure 31:
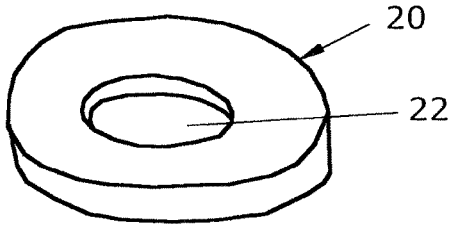
FIG. 31 illustrates a schematic view of a jacket.
Figure 32:
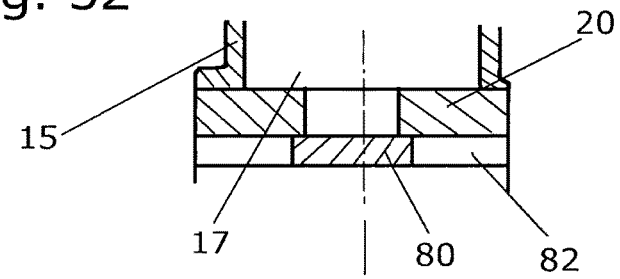
FIG. 32 illustrates a schematic partial view of the inlet valve.

FIG. 31 illustrates a jacket 20 forming the inlet valve with a jacket opening 22 made from rubber elastic or flexible material. FIG. 32 illustrates the inlet valve with the jacket 20. It is evident that a piston 80 is arranged below the jacket opening 22 wherein the piston 80 closes the jacket opening 22 in the position illustrated in FIG. 32. The piston 80 is clamped through plural radial arms 82, thus four radial arms 82 relative to the sleeve 18 protruding from the cartridge and the jacket is clamped under the sleeve 15 preloaded by a spring 14 and clamped in particular by the undercut clamping arms 19.

When a vacuum is generated in the pump cylinder 42 the edge of the jacket opening 22 lifts slightly in upward direction, this means it is bent in upward direction so that an annular gap is formed between the piston 80 and the jacket opening 22 wherein the annular gap facilitates an output of the material from the cartridge arranged below the piston 80 through the annular gap in upward direction to the pump cylinder 42.

This is an advantageous embodiment of the inlet valve, wherein it is appreciated that also other suitable valve arrangements can be used. In this respect the illustrated embodiment does not limit the scope of the instant invention.

Last not least independent patent protection is claimed for all individual features even when these features are described in an exemplary manner in combination with other features.

The invention claimed is:

1. A metering dispenser dispensing out a pasty or viscous material, the metering dispenser comprising:

an elongated tubular shaped dispenser housing;

a container cartridge received in the dispenser housing and configured for storing the material;

a pump unit including a pump piston and a pump housing wherein the pump unit is configured to provide a material output through the cartridge;

an applicator;

a cover cap; and an actuation device configured to dispense a material out from the applicator;

wherein the actuation device comprises a push button which is arranged at an end of the dispenser housing and received axially moveable in a housing longitudinal direction so that an axial actuation of the push button into the dispenser housing activates the pump unit to provide a material output through the cartridge;

wherein the metering dispenser includes an adjustment device that is configured to be positioned in a blocking position that prevents material output, and at least one of in a functional position that allows the material output and a plurality of functional positions that allows differently metered material outputs, wherein the push button is connected with the cartridge in a direction of the longitudinal axis of the dispenser housing and wherein the push button is connected torque-proof with the cartridge through a coupling device so that the adjustment of the adjustment device into at least one of the blocking position, the functional position and the plurality of functional positions is made by turning the push button;

wherein the adjustment device includes at least one lug arranged at a sleeve element of the cartridge, and at least one stop device respectively associated with the at least one lug arranged at an inner wall of the housing that receives the cartridge;

wherein the at least one stop device defines at least one blocking position;

wherein the stop device includes a plurality of stops to facilitate plural different length strokes of the cartridge in a direction toward the pump unit for a different metering of an output volume in addition to the blocking position; and wherein the plurality of stops are arranged in a stair case configuration at an inner wall of the dispenser housing at an inward protruding stair case wall arrangement so that a stroke length of the cartridge and thus the output volume is incremented.

2. The metering dispenser according to claim 1, wherein the push button is connected with the cartridge through an interlocking connection that includes an insertion component engaging an interior of the cartridge;

wherein an engagement lug is positioned at the insertion component;

wherein at least one of the engagement lug cooperates with at least one of a complementary interlocking recess and an interlocking shoulder of the cartridge, and the inner wall of the housing is provided with a recess axially extending in a direction of the housing longitudinal axis; and wherein the recess includes an annular axial cavity configured to support the cartridge which engages the axial cavity through an interlocking protrusion.

3. The metering dispenser according to claim 1, wherein the cartridge includes a base wall including at least one opening and arranged at an end portion of the cartridge that is oriented towards the pump unit;

wherein a sleeve element of the cartridge extends from the base wall;

wherein a cartridge sleeve receives the pump unit and the sleeve element defining a pump cylinder;

wherein the sleeve element interacts with the pump piston that includes at least one of a material pass through with a spring connected there between, and a valve member closing the pass through of the pump piston;

wherein the valve member is preloaded by a spring in a closure position against an opening of the pump housing;

wherein moving the cartridge in a direction towards the pump unit moves the sleeve element relative to the pump or hollow piston of the pump unit which penetrates the sleeve element and reduces a size of a pump cavity; and wherein the sleeve element is returned into its starting position by the spring taking along the cartridge after disengaging the push button.

4. The metering dispenser according to claim 1, wherein the adjustment movement is provided by rotating a turning button which is connected torque proof with the cartridge and thus by at least one lug that engages complementary interlocking recesses at the cartridge.

5. The metering dispenser according claim 4, wherein at least one of the adjustment positions of the turning button and of the cartridge are interlockable;

wherein the interlocking positions are disengageable by a pressure in order to change the adjustment position; and wherein at least one interlocking member is provided at the turning button for interlocking a semi spherical interlocking protrusion which is interlockable in a complementary interlocking recess of the dispenser housing.

6. The metering dispenser according to claim 5, wherein the interlocking member is arranged radially outward protruding at the interlocking lug of the push button.

7. The metering dispenser according to claim 1, wherein the dispenser housing of the metering dispenser includes a central support element with interface configurations configured to receive and support at least one of the pump unit, the applicator, the cap, the push button and the cartridge; and wherein the interface configurations of the dispenser housing comprise at least one of an inserted snug fit, an interlocking connection, and a clip connection.

8. The metering dispenser according to claim 7, wherein the dispenser housing receives the pump unit through at least one of the inserted snug fit including at least one of a press fit and a clamping fit, the interlocking connection, and the clip connection, and the cartridge is suspended at the pump unit.

9. The metering dispenser according to claim 1, wherein the cartridge is axially moveable relative to the pump housing through axial pressure actuation of the push button and a relative movement between the sleeve element of the cartridge and a sleeve of the pump housing, such that the sleeve of the pump housing penetrates the sleeve element of the cartridge.

10. The metering dispenser according to claim 1, wherein the pump unit includes a self-closing inlet valve for receiving material from the cartridge;

wherein the inlet valve comprises a jacket comprising at least one of a rubber elastic and a flexible material, the jacket including a closure opening;

wherein the pump unit includes a self-closing outlet valve for material output to the applicator; and wherein the outlet valve comprises a spring with a closure head which closes an output opening of the pump unit in a closure position under a spring load.

11. The metering dispenser according to claim 10, wherein the jacket is arranged in the sleeve element that protrudes from the cartridge and the jacket is supported by a sleeve defining an annular cavity of a pump cylinder of the pump unit, the jacket is clamped relative to a base of the cartridge, and the jacket has a larger diameter than the pump cylinder of the pump unit, where the pump cylinder comprises a sleeve pressed into a cartridge boss.

12. The metering dispenser according to claim 11, wherein the sleeve defining the pump cylinder is supported by at least one clamping arm of the sleeve element by an undercut provided as an interlocking shoulder oriented perpendicular to the housing axis; and wherein the interlocking shoulder also contacts a face of an annular flange oriented perpendicular to the housing axis.

* * * * *